US010408438B2

(12) United States Patent
Hsu

(10) Patent No.: US 10,408,438 B2
(45) Date of Patent: Sep. 10, 2019

(54) CEILING FITTING WITH A LIGHTING MODULE

(71) Applicant: Dong Guan Bright Yinhuey Lighting Co., Ltd. China, Guang Dong (CN)

(72) Inventor: Kevin Hsu, Taichung (TW)

(73) Assignee: Dong Guan Bright Yinhuey Lighting Co., Ltd. China, Guang Dong (CN)

( * ) Notice: Subject to any disclaimer, the term of this patent is extended or adjusted under 35 U.S.C. 154(b) by 24 days.

(21) Appl. No.: 15/891,439

(22) Filed: Feb. 8, 2018

(65) Prior Publication Data

US 2019/0242559 A1 Aug. 8, 2019

(51) Int. Cl.

| | |
|---|---|
| ***F21V 17/10*** | (2006.01) |
| ***F21V 21/04*** | (2006.01) |
| ***F21V 21/08*** | (2006.01) |
| ***F21S 8/04*** | (2006.01) |
| *H01R 13/436* | (2006.01) |
| *F21Y 115/10* | (2016.01) |

(52) U.S. Cl.

CPC ..... *F21V 21/047* (2013.01); *F21S 8/04* (2013.01); *F21V 17/108* (2013.01); *F21V 21/0832* (2013.01); *F21Y 2115/10* (2016.08); *H01R 13/4362* (2013.01)

(58) Field of Classification Search

CPC ..... F21V 21/00; F21V 17/00; F21V 21/042; F21V 21/03; F21V 21/0832; F21V 21/02; F21V 21/043; F21V 21/088; F21V 21/047; F21V 21/044; F21V 21/045; F21V 21/046; F21V 17/108; F21V 17/10; F21V 17/104; F21V 3/00; F21V 19/003; F21V 19/0015; F21V 23/06; F21V 17/12; F16M 13/027; F16M 13/02; F16M 13/022; F16L 3/015; H02G 3/20; F21Y 2115/10; F21S 8/043; F21S 8/046; F21S 8/04; F21S 8/036; H01R 13/4362; H01R 13/00; F16B 2/20

See application file for complete search history.

(56) References Cited

U.S. PATENT DOCUMENTS 6,623,138 B1 * 9/2003 Hsu ..... F21V 21/03 362/147
6,669,159 B1 * 12/2003 Hsu ..... F21V 3/00 248/317
6,682,036 B1 * 1/2004 Hsu ..... F21S 8/04 248/342

(Continued)

*Primary Examiner* — Anh T Mai
*Assistant Examiner* — Fatima N Farokhrooz
(74) *Attorney, Agent, or Firm* — Alan D. Kamrath; Mayer & Williams PC

(57) ABSTRACT

A ceiling fitting includes a canopy provided with a fixed hook and a mounting hole, a movable hook mounted on the mounting hole of the canopy and having an arcuate restriction portion, a lighting module removably mounted on the canopy, and an outer cover covering the lighting module. The lighting module includes a lamp board mounted on the canopy and located between the movable hook and the fixed hook, and a light permeable shell mounted on the lamp board. The lamp board is provided with a first retaining groove and a second retaining groove. The first retaining groove is locked onto the movable hook, with the restriction portion of the movable hook being retained by the first retaining groove of the lamp board. The second retaining groove is locked onto the fixed hook.

10 Claims, 9 Drawing Sheets

(56) References Cited

U.S. PATENT DOCUMENTS

| | | | | |
|---|---|---|---|---|
| 2004/0095752 | A1* | 5/2004 | Hsu | F21S 8/04<br>362/147 |
| 2016/0084491 | A1* | 3/2016 | Boomgaarden | F21V 21/041<br>362/267 |
| 2018/0010779 | A1* | 1/2018 | Zhou | F21V 25/00 |

* cited by examiner

CEILING FITTING WITH A LIGHTING MODULE

BACKGROUND OF THE INVENTION

1. Field of the Invention

The present invention relates to a lighting device and, more particularly, to a ceiling fitting.

2. Description of the Related Art

A ceiling fitting is mounted on a ceiling (or wall) to provide a lighting function. A conventional ceiling fitting comprises a light source which uses an LED instead of the E27 bulb. The conventional ceiling fitting further comprises a canopy, an aluminum base plate and a protective cover. The canopy is attached to the ceiling. The aluminum base plate and the protective cover are secured to the canopy by screws. However, the light source and the canopy are combined integrally and cannot be replaced or repaired individually, so that it is necessary to replace the whole ceiling fitting when the light source or the canopy is worn out, thereby increasing the cost.

BRIEF SUMMARY OF THE INVENTION

In accordance with the present invention, there is provided a ceiling fitting comprising a canopy, a movable hook mounted on the canopy, a lighting module removably mounted on the canopy, and an outer cover mounted on the canopy and covering the lighting module. The canopy is provided with a fixed hook and a mounting hole located opposite to the fixed hook. The movable hook is mounted on the mounting hole. The movable hook has a side having a middle position bent outward and forming an arcuate restriction portion. The lighting module includes a lamp board mounted on the canopy and located between the movable hook and the fixed hook, and a light permeable shell mounted on the lamp board. The lamp board has a periphery provided with a first retaining groove and a second retaining groove. The first retaining groove is locked onto the movable hook, with the restriction portion of the movable hook being retained by the first retaining groove of the lamp board. The second retaining groove is locked onto the fixed hook.

According to the primary advantage of the present invention, the lighting module and the canopy are replaced individually, thereby decreasing the cost of replacement and maintenance.

According to another advantage of the present invention, the user only needs to press the movable hook to detach the lamp board from the movable hook so as to remove the lighting module from the canopy, so that the lighting module and the canopy are assembled and disassembled easily and conveniently.

According to a further advantage of the present invention, the lighting module is removed from the canopy easily and quickly, thereby facilitating the user replacing the lighting module and the canopy.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
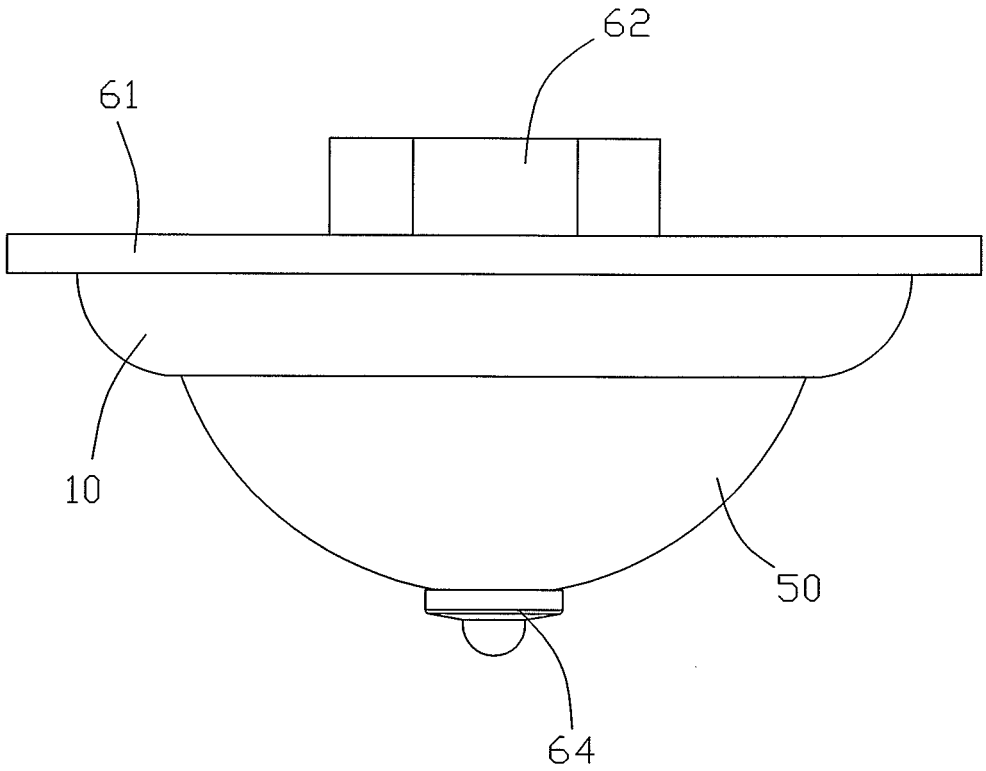
FIG. 1 is a schematic plane view of a ceiling fitting in accordance with the preferred embodiment of the present invention.
Figure 2:
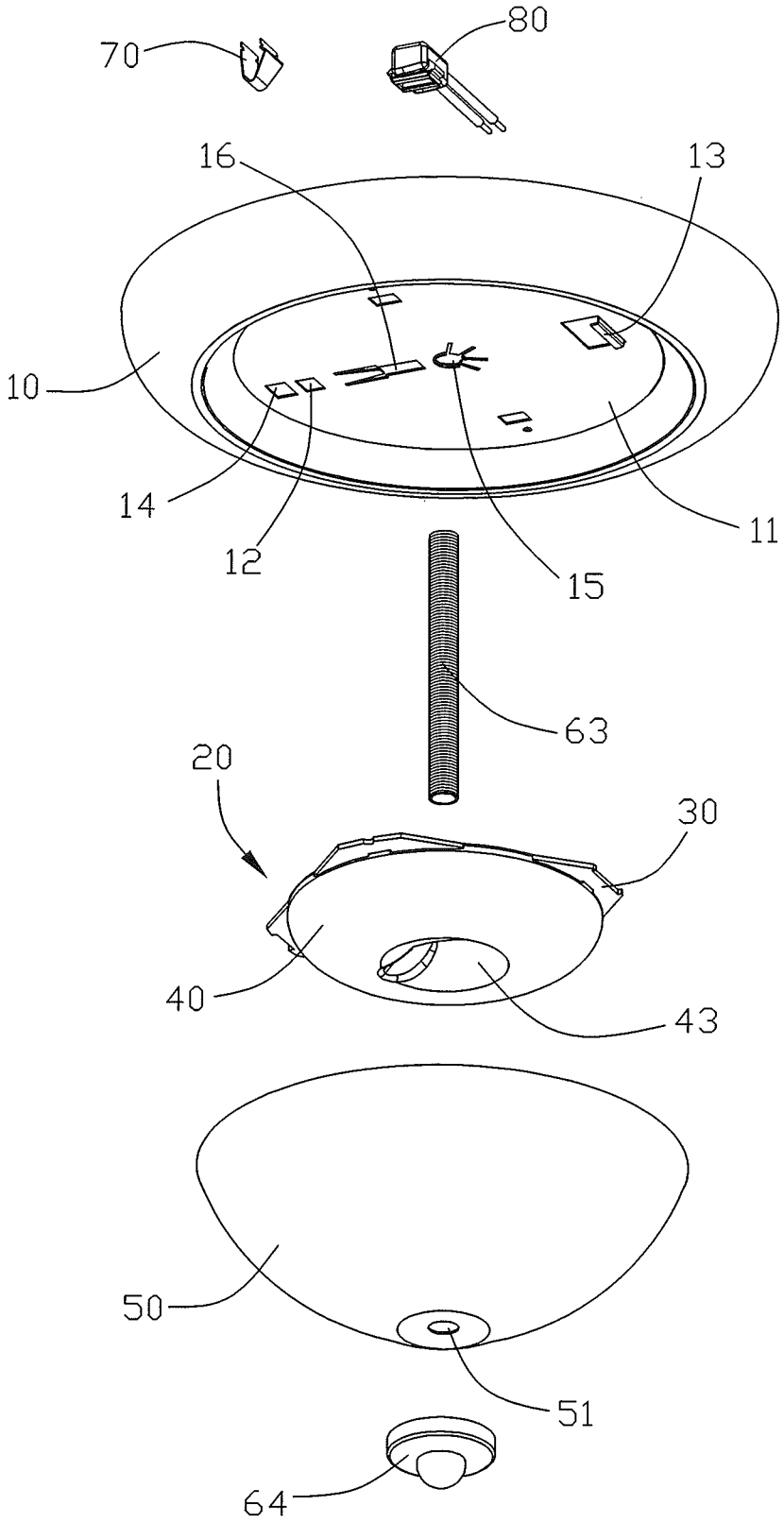
FIG. 2 is an exploded perspective view of the ceiling fitting in accordance with the preferred embodiment of the present invention.
Figure 3:
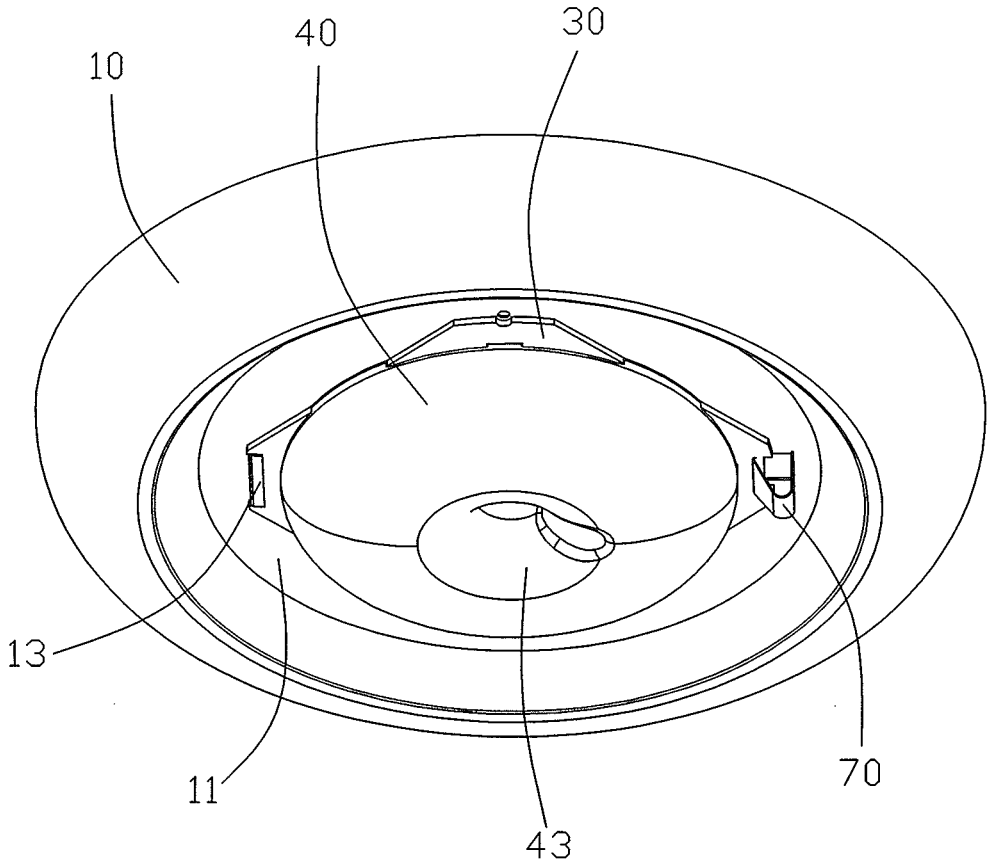
FIG. 3 is a partially perspective view of the ceiling fitting in accordance with the preferred embodiment of the present invention.
Figure 4:
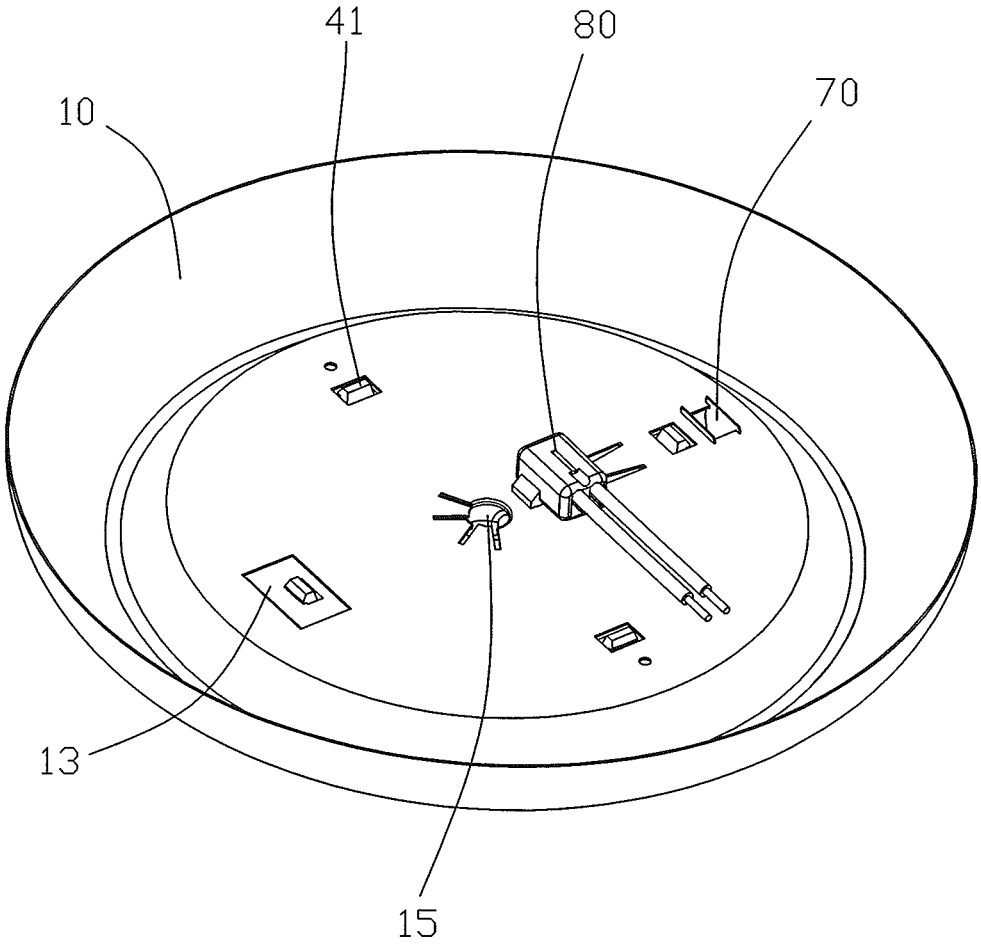
FIG. 4 is a top perspective view of the ceiling fitting as shown in FIG. 3.
Figure 5:
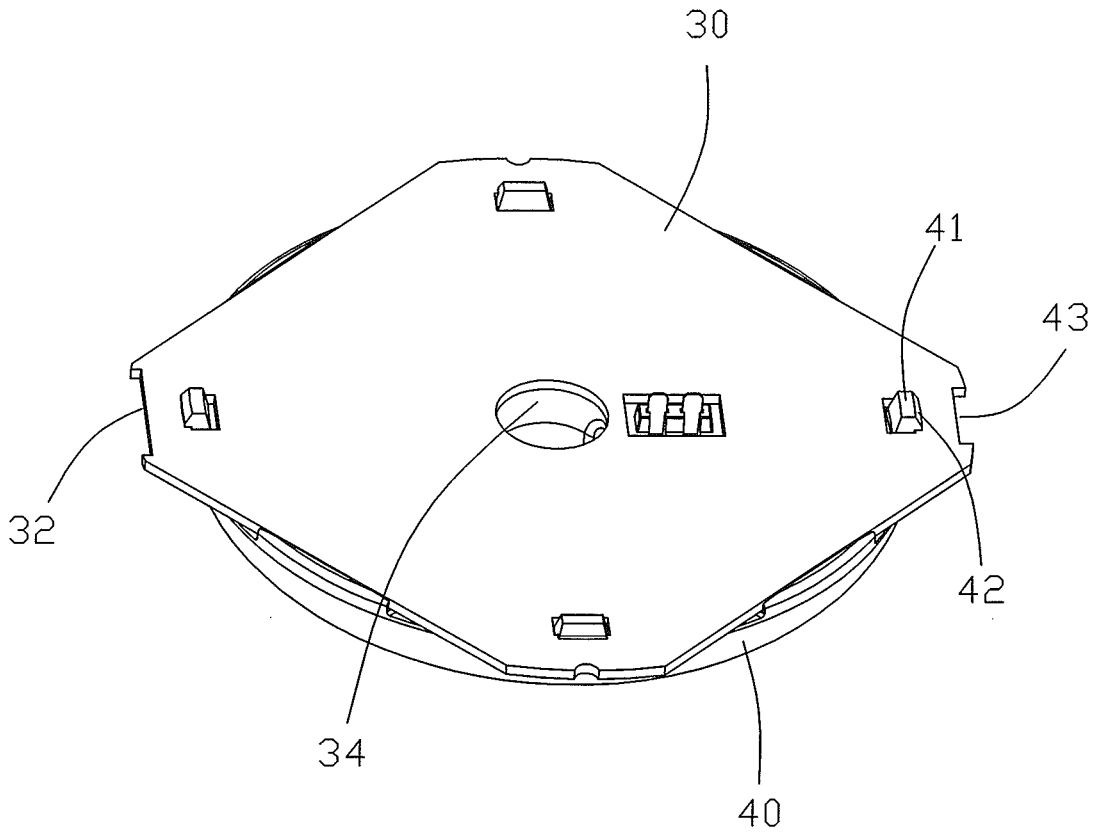
FIG. 5 is a perspective view of a lighting module of the ceiling fitting in accordance with the preferred embodiment of the present invention.
Figure 6:
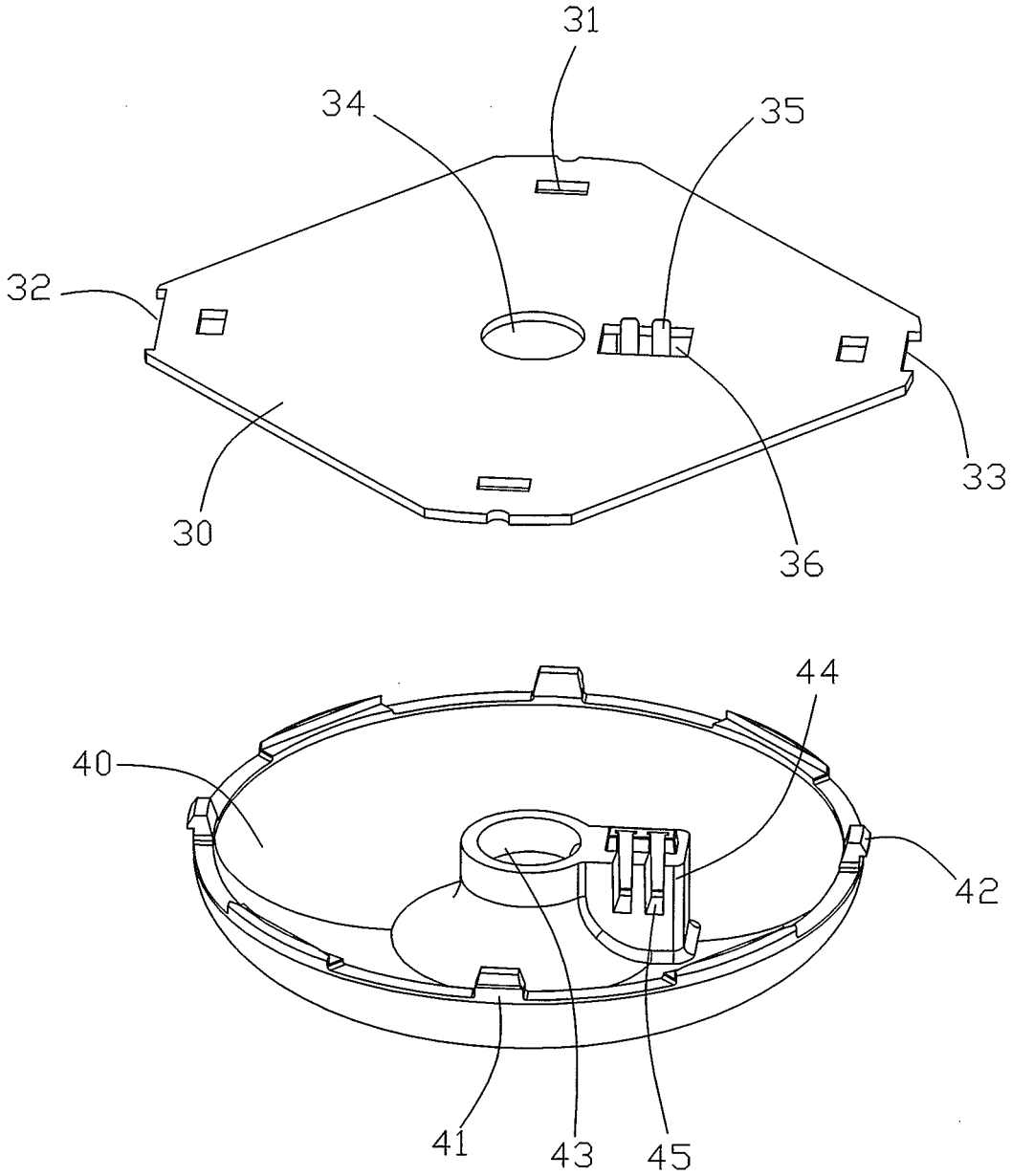
FIG. 6 is an exploded perspective view of the lighting module of the ceiling fitting as shown in FIG. 5.
Figure 7:
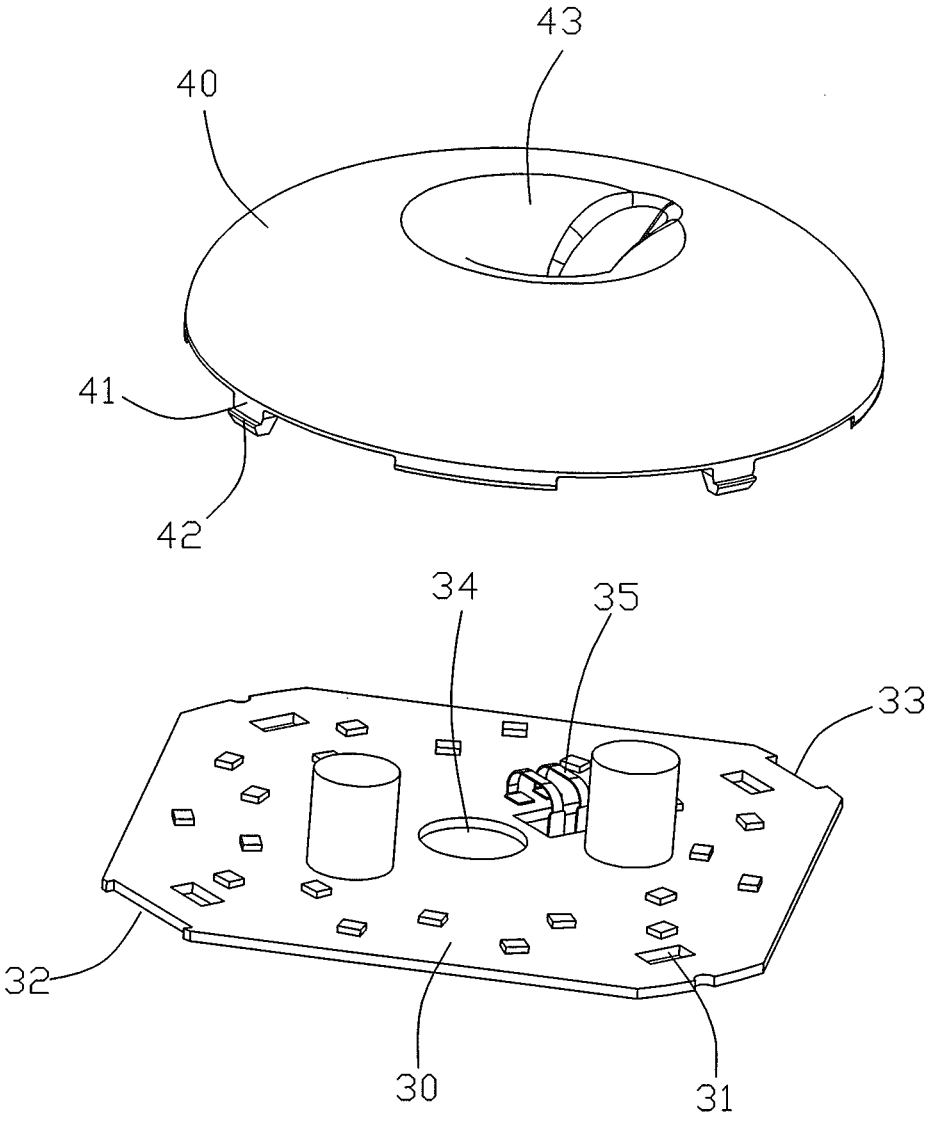
FIG. 7 is another exploded perspective view of the lighting module of the ceiling fitting in accordance with the preferred embodiment of the present invention.
Figure 8:
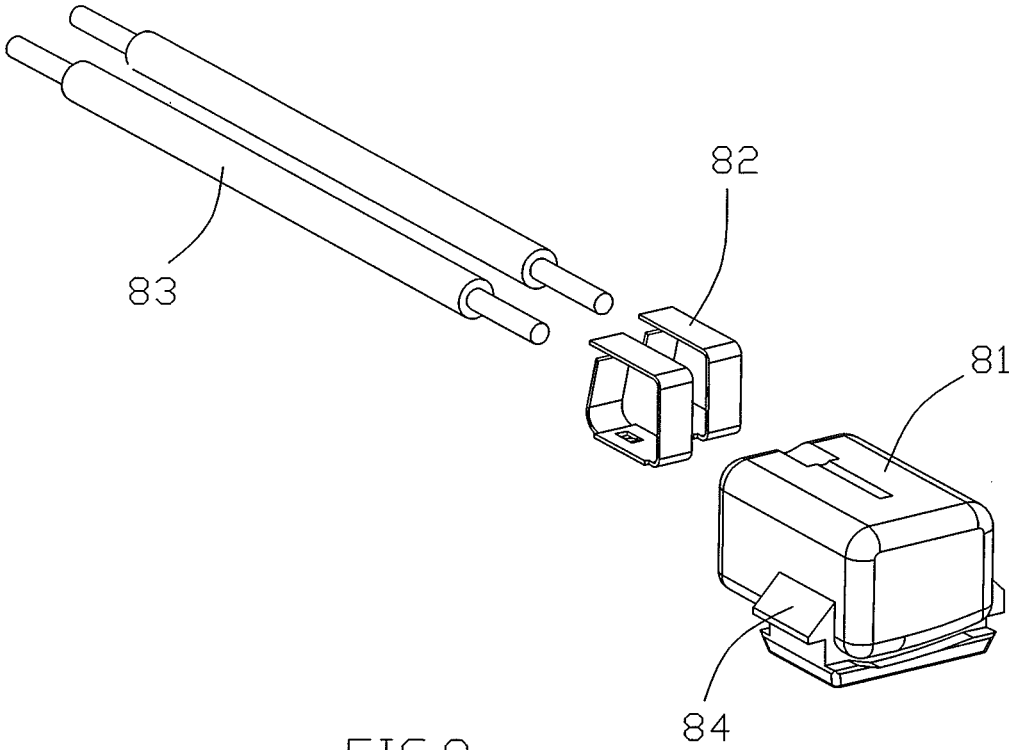
FIG. 8 is an exploded perspective view of a terminal unit of the ceiling fitting in accordance with the preferred embodiment of the present invention.
Figure 9:
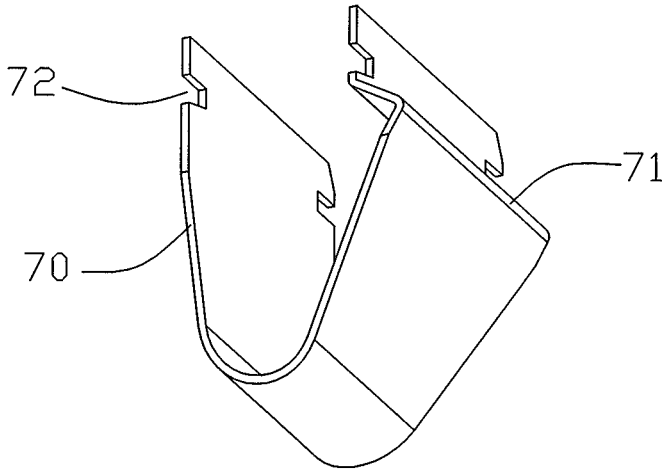
FIG. 9 is a perspective view of a movable hook of the ceiling fitting in accordance with the preferred embodiment of the present invention.

Referring to FIGS. 1-9, a ceiling fitting in accordance with the preferred embodiment of the present invention comprises a canopy 10, a movable hook 70 mounted on the canopy 10, a lighting module 20 removably mounted on the canopy 10, and an outer cover 50 mounted on the canopy 10 and covering the lighting module 20. The canopy 10 is provided with a fixed hook 13 and a mounting hole 14 located opposite to the fixed hook 13. The movable hook 70 is mounted on the mounting hole 14. The movable hook 70 has a side having a middle position bent outward and forming an arcuate restriction portion 71. The lighting module 20 includes a lamp board 30 mounted on the canopy 10 and located between the movable hook 70 and the fixed hook 13, and a light permeable shell 40 mounted on the lamp board 30. The lamp board 30 has a periphery provided with a first retaining groove 32 and a second retaining groove 33. The first retaining groove 32 is locked onto the movable hook 70, with the restriction portion 71 of the movable hook 70 being retained by the first retaining groove 32 of the lamp board 30. The second retaining groove 33 is locked onto the fixed hook 13.

In the preferred embodiment of the present invention, the lamp board 30 is provided with a plurality of locking holes 31. The light permeable shell 40 is provided with a plurality of locking projections 41 locked in the locking holes 31 of the lamp board 30. Each of the locking projections 41 has an upper end provided with a protruding stop portion 42 locked on a face of the lamp board 30. The stop portion 42 is provided with a guide ramp to guide movement of the stop portion 42. When each of the locking projections 41 is inserted into one of the locking holes 31, the stop portion 42 is pushed inward by a wall of the one of the locking holes 31, and the guide ramp of the stop portion 42 slides on the one of the locking holes 31. After the stop portion 42 passes the one of the locking holes 31, the stop portion 42 is pulled outward by its elastic restoring force, so that each of the locking projections 41 is locked in the one of the locking holes 31.

In the preferred embodiment of the present invention, the first retaining groove 32 has an opening greater than that of second retaining groove 33 to provide a foolproof function.

In the preferred embodiment of the present invention, the movable hook 70 is an arcuate bent flexible plate. The movable hook 70 extends through the mounting hole 14 and has two distal ends each provided with two recesses 72 locked on the canopy 10.

In the preferred embodiment of the present invention, the canopy 10 is provided with a first through hole 15, the lamp board 30 is provided with a second through hole 34, the light permeable shell 40 is provided with a third through hole 43, and the outer cover 50 is provided with a fourth through hole 51. The ceiling fitting further comprises a fixture for fixing the canopy 10, the lighting module 20 and the outer cover 50 to a wall. The fixture includes a top board 61 mounted on the canopy 10 and attached to the wall, a fixing member 62 extending through the top board 61 and secured to the wall, a threaded rod 63 mounted on the fixing member 62 and in turn extending through the first through hole 15, the second through hole 34, the third through hole 43 and the fourth through hole 51, and a threaded fastener 64 screwed onto the threaded rod 63 and resting on the outer cover 50. The threaded rod 63 has an external thread, and the threaded fastener 64 has an internal thread screwed onto the external thread of the threaded rod 63.

In the preferred embodiment of the present invention, the canopy 10 is provided with a recessed mounting face 11 having a plurality of receiving grooves 12 surrounding the first through hole 15, and the stop portion 42 of each of the locking projections 41 is received in one of the receiving grooves 12. The first through hole 15 is located a central position of the mounting face 11. The mounting face 11 is provided with the fixed hook 13 and the mounting hole 14. The first through hole 15 is arranged between the fixed hook 13 and the mounting hole 14. The movable hook 70 extends through the mounting hole 14 to a bottom of the mounting face 11. After the movable hook 70 passes the mounting face 11, the arcuate restriction portion 71 is returned to an original position.

In the preferred embodiment of the present invention, the fixed hook 13 has a substantially L-shaped configuration and has a first end integrally formed on the mounting face 11 and a second end directed toward a central position of the canopy 10.

In the preferred embodiment of the present invention, the ceiling fitting further comprises a terminal unit 80 connected with the canopy 10 and including a terminal 81 mounted on the canopy 10, at least one electrically conducting member 82 mounted in the terminal 81, and at least one electric wire 83 connected with the at least one electrically conducting member 82. The canopy 10 is provided with a first locking aperture 16. The lamp board 30 is provided with a second locking aperture 36 and at least one contact. The at least one contact is connected with an LED on the lamp board 30. The terminal 81 has a bottom provided with a locking piece 84 locked in the first locking aperture 16 and the second locking aperture 36.

In the preferred embodiment of the present invention, the ceiling fitting further comprises at least one elastic plate 35 having a first end secured on the at least one contact of the lamp board 30 and a second end connected with the electrically conducting member 82. The second end of the at least one elastic plate 35 extends into the terminal 81.

In the preferred embodiment of the present invention, the light permeable shell 40 is provided with a protrusion 44 having at least one receiving slot 45, and the at least one elastic plate 35 has a bottom received in the at least one receiving slot 45.

In assembly, the movable hook 70 is initially mounted on the canopy 10. The locking projections 41 are inserted into and locked in the locking holes 31, so that the light permeable shell 40 is combined with the lamp board 30 to construct the lighting module 20. When the lighting module 20 is mounted on the canopy 10, the second retaining groove 33 is directly locked onto the fixed hook 13, and the first retaining groove 32 is mounted on the movable hook 70. When the lighting module 20 is pushed toward the canopy 10, the first retaining groove 32 slides on and presses the movable hook 70, so that the movable hook 70 is elastically deformed outward. After the first retaining groove 32 passes and is located above the restriction portion 71, the movable hook 70 is returned to the original state by its elasticity, so that the first retaining groove 32 is locked onto the movable hook 70. In such a manner, the first retaining groove 32 is locked onto the movable hook 70, and the second retaining groove 33 is locked onto the fixed hook 13, so that the lamp board 30 is secured to the canopy 10 to attach the lighting module 20 to the canopy 10. At this time, the locking projections 41 are received in the receiving grooves 12. Then, the threaded rod 63 in turn extends through the first through hole 15, the second through hole 34 and the third through hole 43. Then, the outer cover 50 is mounted on the canopy 10 to cover the lighting module 20, with the threaded rod 63 extending through and protruding outward from the fourth through hole 51. Finally, the threaded fastener 64 is screwed onto the threaded rod 63 and presses the outer cover 50. Thus, assembly of the ceiling fitting is accomplished.

When the user wishes to replace the canopy 10 or the lighting module 20, the threaded fastener 64 is unscrewed from the threaded rod 63, and the outer cover 50 is removed from the canopy 10. Then, the canopy 10 and the lighting module 20 are removed from the threaded rod 63. Then, the movable hook 70 is pressed outward to detach the first retaining groove 32 from the movable hook 70, so that the lamp board 30 is detached from the canopy 10 so as to remove the lighting module 20 from the canopy 10.

Accordingly, the lighting module 20 and the canopy 10 are replaced individually, thereby decreasing the cost of replacement and maintenance. In addition, the user only needs to press the movable hook 70 to detach the lamp board 30 from the movable hook 70 so as to remove the lighting module 20 from the canopy 10, so that the lighting module 20 and the canopy 10 are assembled and disassembled easily and conveniently. Further, the lighting module 20 is removed from the canopy 10 easily and quickly, thereby facilitating the user replacing the lighting module 20 and the canopy 10.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A ceiling fitting comprising:

a canopy;

a movable hook mounted on the canopy;

a lighting module removably mounted on the canopy; and an outer cover mounted on the canopy and covering the lighting module;

wherein:

the canopy is provided with a fixed hook and a mounting hole located opposite to the fixed hook;

the movable hook is mounted on the mounting hole;

the movable hook has a side having a middle position bent outward and forming an arcuate restriction portion;

the lighting module includes a lamp board mounted on the canopy and located between the movable hook and the fixed hook, and a light permeable shell mounted on the lamp board;

the lamp board has a periphery provided with a first retaining groove and a second retaining groove;

the first retaining groove is locked onto the movable hook, with the restriction portion of the movable hook being retained by the first retaining groove of the lamp board; and the second retaining groove is locked onto the fixed hook.

2. The ceiling fitting of claim 1, wherein:

the lamp board is provided with a plurality of locking holes;

the light permeable shell is provided with a plurality of locking projections locked in the locking holes of the lamp board;

each of the locking projections has an upper end provided with a protruding stop portion locked on a face of the lamp board; and the stop portion is provided with a guide ramp to guide movement of the stop portion.

3. The ceiling fitting of claim 1, wherein the first retaining groove has an opening greater than that of second retaining groove.

4. The ceiling fitting of claim 1, wherein:

the movable hook is an arcuate bent flexible plate; and the movable hook extends through the mounting hole and has two distal ends each provided with two recesses locked on the canopy.

5. The ceiling fitting of claim 1, wherein:

the canopy is provided with a first through hole, the lamp board is provided with a second through hole, the light permeable shell is provided with a third through hole, and the outer cover is provided with a fourth through hole;

the ceiling fitting further comprises a fixture for fixing the canopy, the lighting module and the outer cover; and the fixture includes a top board mounted on the canopy, a fixing member extending through the top board, a threaded rod mounted on the fixing member and in turn extending through the first through hole, the second through hole, the third through hole and the fourth through hole, and a threaded fastener screwed onto the threaded rod and resting on the outer cover.

6. The ceiling fitting of claim 1, further comprising:

a terminal unit connected with the canopy and including a terminal mounted on the canopy, at least one electrically conducting member mounted in the terminal, and at least one electric wire connected with the at least one electrically conducting member;

wherein:

the canopy is provided with a first locking aperture;

the lamp board is provided with a second locking aperture and at least one contact; and the terminal has a bottom provided with a locking piece locked in the first locking aperture and the second locking aperture.

7. The ceiling fitting of claim 2, wherein the canopy is provided with a recessed mounting face having a plurality of receiving grooves surrounding the first through hole, and the stop portion of each of the locking projections is received in one of the receiving grooves.

8. The ceiling fitting of claim 7, wherein the fixed hook has a substantially L-shaped configuration and has a first end integrally formed on the mounting face and a second end directed toward a central position of the canopy.

9. The ceiling fitting of claim 6, further comprising:

at least one elastic plate having a first end secured on the at least one contact of the lamp board and a second end connected with the electrically conducting member;

wherein:

the second end of the at least one elastic plate extends into the terminal.

10. The ceiling fitting of claim 9, wherein the light permeable shell is provided with a protrusion having at least one receiving slot, and the at least one elastic plate has a bottom received in the at least one receiving slot.

* * * * *